US011472670B2

(12) United States Patent
Shiraishi et al.

(10) Patent No.: US 11,472,670 B2
(45) Date of Patent: Oct. 18, 2022

(54) SAFETY GEAR FOR AN ELEVATOR

(71) Applicant: Mitsubishi Electric Corporation, Tokyo (JP)

(72) Inventors: Naohiro Shiraishi, Tokyo (JP); Seiji Watanabe, Tokyo (JP); Mitsuhiro Yamazumi, Tokyo (JP); Masayuki Kakio, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 91 days.

(21) Appl. No.: 16/638,151

(22) PCT Filed: Oct. 6, 2017

(86) PCT No.: PCT/JP2017/036496
§ 371 (c)(1),
(2) Date: Feb. 11, 2020

(87) PCT Pub. No.: WO2019/069453
PCT Pub. Date: Apr. 11, 2019

(65) Prior Publication Data

US 2020/0223665 A1 Jul. 16, 2020

(51) Int. Cl.
*B66B 5/22* (2006.01)

(52) U.S. Cl.
CPC ..... *B66B 5/22* (2013.01)

(58) Field of Classification Search
CPC ..... B66B 5/22; B66B 5/26; B66B 5/16
See application file for complete search history.

(56) References Cited

FOREIGN PATENT DOCUMENTS

| | | | | |
|---|---|---|---|---|
| CN | 201473143 U | | 5/2010 | |
| CN | 201857179 U | | 6/2011 | |
| CN | 104276478 A | * | 1/2015 | |
| CN | 109693987 A | * | 4/2019 | |
| CN | 110194402 A | * | 9/2019 | |
| DE | 102019106627 A1 | * | 9/2020 | ..... B66B 5/18 |

(Continued)

OTHER PUBLICATIONS

English Machine Translation of CN 109693987 Apr. 2019.*

(Continued)

*Primary Examiner* — Diem M Tran
(74) *Attorney, Agent, or Firm* — Xsensus LLP

(57) ABSTRACT

In a safety gear for an elevator, a pressing spring device applies a resistance force against movement of a normal-wedge guide member in a direction of moving away from a guide rail. A normal-wedge member has a reverse-wedge guide surface becoming more distant from the guide rail as extending upward. A reverse-wedge member is movable with respect to the normal-wedge member along the reverse-wedge guide surface. A vertical-direction spring device applies a resistance force against upward movement of the reverse-wedge member with respect to the normal-wedge member. A spring constant of the vertical-direction spring device is lower than a spring constant of the pressing spring device. The vertical-direction spring device has a region in which a rate of change in force generated along with increase in upward displacement amount of the reverse-wedge member with respect to the normal-wedge member decreases as compared to that in initial displacement.

8 Claims, 12 Drawing Sheets

(56) References Cited

FOREIGN PATENT DOCUMENTS

| | | | | | |
|---|---|---|---|---|---|
| JP | 2001-192184 | A | | 7/2001 | |
| JP | 2014065591 | A | * | 4/2014 | |
| WO | 2014/020743 | A1 | | 2/2014 | |
| WO | 2017/094102 | A1 | | 6/2017 | |
| WO | WO-2018020572 | A1 | * | 2/2018 | ..... B66B 5/22 |

OTHER PUBLICATIONS

Machine translation of CN 1044276478 A.*
International Search Report and Written Opinion dated Dec. 12, 2017 for PCT/JP2017/036496 filed on Oct. 6, 2017, 9 pages including English Translation of the International Search Report.
Indian Office Action dated Feb. 18, 2021, in corresponding Indian Patent Application No. 202047011159.
Office Action dated Mar. 28, 2022, in corresponding Indian patent Application No. 202148019113, 5 pages.

* cited by examiner

SAFETY GEAR FOR AN ELEVATOR

CROSS-REFERENCE TO RELATED APPLICATION

The present application is based on PCT filing PCT/JP2017/036496, filed Oct. 6, 2017, the entire contents of which are incorporated herein by reference.

TECHNICAL FIELD

The present invention relates to a safety gear for an elevator, which is installed on an ascending/descending body being vertically movable along a guide rail, and is configured to bring the ascending/descending body to an emergency stop by a frictional force generated between the guide rail and the safety gear.

BACKGROUND ART

In general, a car of an elevator has a safety gear installed thereon. The safety gear includes a wedge-like braking piece. When a lowering speed of the car exceeds a set value, a speed governor is actuated so that the braking piece is pressed against a guide rail. Consequently, the car is brought to an emergency stop by a frictional force generated between the braking piece and the guide rail.

At this time, the frictional force, namely, a braking force fluctuates depending on a coefficient of friction between the braking piece and the guide rail. That is, even when a normal reaction that is generated when a braking surface of the braking piece is pressed against a braking surface of the guide rail is constant, the braking force changes depending on, for example, a condition of the braking surface and a braking speed. For example, immediately after start of speed reduction, the braking speed is high, and the frictional force is small. Thus, deceleration is reduced. In contrast, immediately after end of speed reduction, the braking speed is low, and the frictional force is large. Thus, the deceleration is suddenly increased.

In this context, in a related-art safety gear for an elevator, a wedge-like body including a wedge main body and a reverse wedge is used. The wedge main body is movable along an inclined surface of a guide plate. The reverse wedge is movable with respect to the wedge main body in an up-and-down direction. An elastic member is interposed between an upper end portion of the reverse wedge and the wedge main body. A flat spring is provided on a side opposite to a car guide rail with respect to the guide plate.

When the coefficient of friction is increased during actuation of the safety gear, the elastic member is compressed. As a result, a pressing force in a horizontal direction is reduced, and the braking force is prevented from being excessively large. Conversely, when the coefficient of friction is reduced, the elastic member is expanded. As a result, the pressing force in the horizontal direction is increased, and the braking force is prevented from being excessively small.

Further, an initial pressure regulating member is mounted to the elastic member. As a result, load and bending characteristic of the elastic member change in two phases, and the braking force is adjusted through use of almost all of a movable range of the reverse wedge (for example, see Patent Literature 1).

CITATION LIST

Patent Literature

[PTL 1] JP 2001-192184 A

SUMMARY OF INVENTION

Technical Problem

In the related-art safety gear described above, the load and the bending characteristic of the elastic member change in two phases. Accordingly, there is a fear in that the braking force suddenly changes at an inflection point of the characteristic of the elastic member to thereby generate an impact on the car.

The present invention has been made to solve the problem described above, and has an object to obtain a safety gear for an elevator capable of generating a braking force more stably while suppressing an impact generated on a car even when a coefficient of friction changes.

Solution to Problem

According to one embodiment of the present invention, there is provided a safety gear for an elevator, including: a frame body provided on an ascending/descending body that moves while being guided along a guide rail; a normal wedge guide member, which has a normal wedge guide surface becoming closer to the guide rail as extending upward, and is movable with respect to the frame body in a horizontal direction; a pressing spring device, which is provided between the frame body and the normal wedge guide member, and is configured to apply a resistance force against movement of the normal wedge guide member in a direction of moving away from the guide rail; a normal wedge member, which is provided on the guide rail side of the normal wedge guide member, and is pulled upward at the time of emergency braking of the ascending/descending body to be moved along the normal wedge guide surface; a reverse wedge member, which is provided on the guide rail side of the normal wedge member, and is pulled upward together with the normal wedge member at the time of emergency braking of the ascending/descending body to be pressed against the guide rail; and a vertical-direction spring device, wherein the normal wedge member has a reverse wedge guide surface becoming more distant from the guide rail as extending upward, wherein the reverse wedge member is movable with respect to the normal wedge member along the reverse wedge guide surface, wherein the vertical-direction spring device is configured to apply a resistance force against upward movement of the reverse wedge member with respect to the normal wedge member, wherein a spring constant of the vertical-direction spring device is lower than a spring constant of the pressing spring device, and wherein the vertical-direction spring device has a characteristic of having a region in which a rate of change in force generated along with increase in upward displacement amount of the reverse wedge member with respect to the normal wedge member decreases as compared to that in initial displacement.

Further, according to one embodiment of the present invention, there is provided a safety gear for an elevator, including: a frame body provided on an ascending/descending body that moves while being guided along a guide rail; a normal wedge guide member, which has a normal wedge guide surface becoming closer to the guide rail as extending upward, and is movable with respect to the frame body in a horizontal direction; a main pressing spring device provided between the frame body and the normal wedge guide member, and configured to apply a resistance force against movement of the normal wedge guide member in a direction of moving away from the guide rail; a normal wedge member, which is provided on the guide rail side of the normal wedge guide member, and is pulled upward at the time of emergency braking of the ascending/descending body to be moved along the normal wedge guide surface and pressed against the guide rail; a reverse wedge guide member provided on the frame body on an opposite side of the normal wedge member with respect to the guide rail; a reverse wedge member provided on the guide rail side of the reverse wedge guide member; and a vertical-direction spring device, wherein the reverse wedge guide member has a reverse wedge guide surface becoming more distant from the guide rail as extending upward, wherein the reverse wedge member is movable with respect to the reverse wedge guide member along the reverse wedge guide surface, wherein the vertical-direction spring device is configured to apply a resistance force against upward movement of the reverse wedge member with respect to the reverse wedge guide member, wherein a spring constant of the vertical-direction spring device is lower than a spring constant of the main pressing spring device, wherein the vertical-direction spring device has a characteristic of having a region in which a rate of change in force generated along with increase in upward displacement amount of the reverse wedge member with respect to the reverse wedge guide member decreases as compared to that in initial displacement.

Advantageous Effects of Invention

According to the safety gear for an elevator of the present invention, the spring constant of the vertical-direction spring device is lower than the spring constant of the pressing spring device. Further, the vertical-direction spring device has the characteristic of having the region in which the rate of change in force generated along with increase in upward displacement amount of the reverse wedge member with respect to the normal wedge member decreases as compared to that in initial displacement. Accordingly, the safety gear can generate a braking force more stably while suppressing an impact generated on the car even when a coefficient of friction changes.

DESCRIPTION OF EMBODIMENTS

Figure 1:
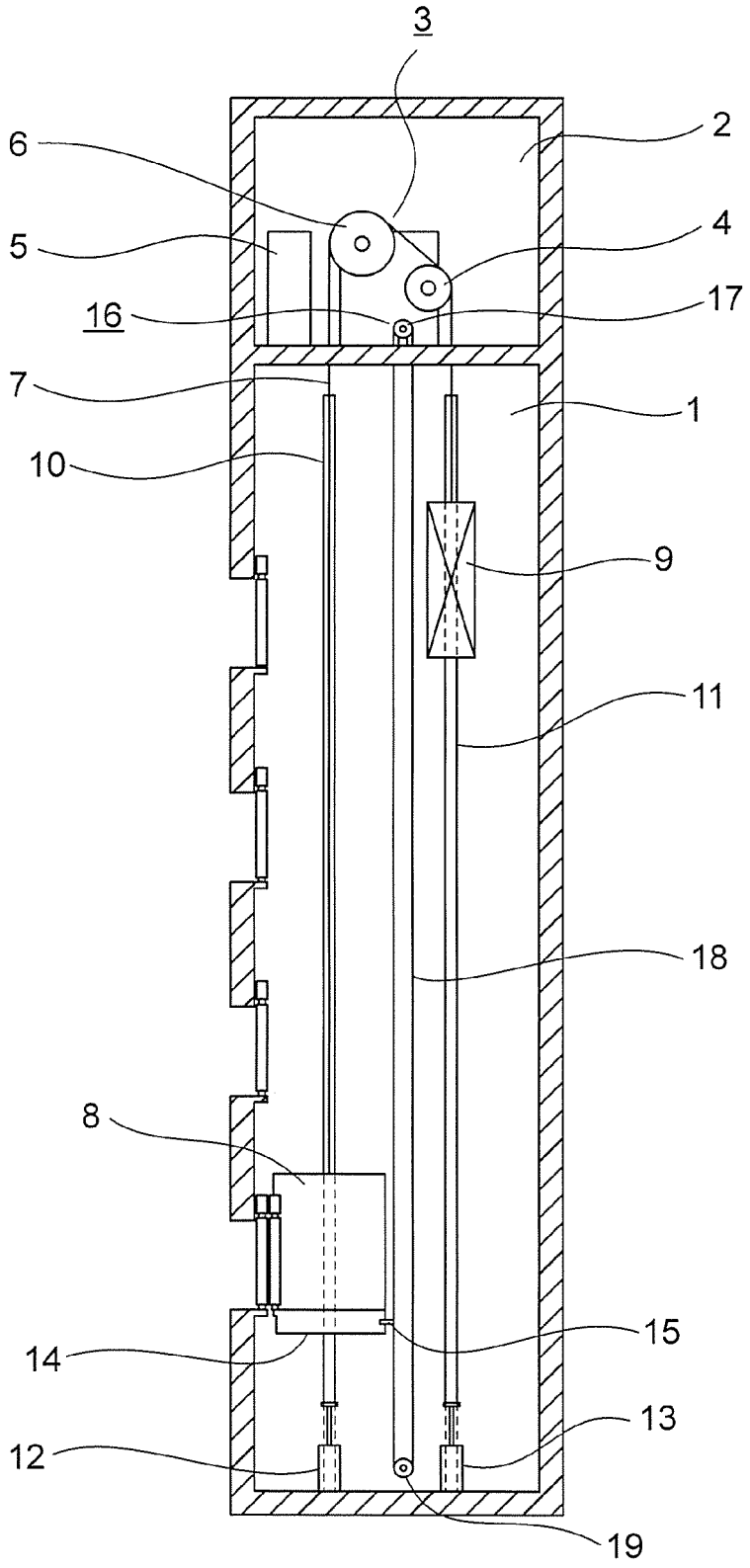
FIG. 1 is a configuration view for illustrating an elevator in a first embodiment of the present invention.

Now, the best mode for carrying out the present invention is described referring to the drawings.

First Embodiment

FIG. 1 is a configuration view for illustrating an elevator in a first embodiment of this invention. In FIG. 1, a machine room 2 is provided in an upper part of a hoistway 1. A hoisting machine 3, a deflector sheave 4, and a controller 5 are installed in the machine room 2. The hoisting machine 3 includes a driving sheave 6, a hoisting machine motor (not shown), and a hoisting machine brake (not shown). The hoisting machine motor is configured to rotate the driving sheave 6. The hoisting machine brake is configured to brake rotation of the driving sheave 6.

A suspension body 7 is wound around the driving sheave 6 and the deflector sheave 4. A plurality of ropes or a plurality of belts are used as the suspension body 7. A car 8 being an ascending/descending body is connected to a first end portion of the suspension body 7. A counterweight 9 being an ascending/descending body is connected to a second end portion of the suspension body 7.

The car 8 and the counterweight 9 are suspended by the suspension body 7 in the hoistway 1. Further, the car 8 and the counterweight 9 are vertically moved in the hoistway 1 through rotation of the driving sheave 6. The controller 5 is configured to control the hoisting machine 3, to thereby vertically move the car 8 at a set speed.

A pair of car guide rails 10 and a pair of counterweight guide rails 11 are installed in the hoistway 1. The pair of car guide rails 10 are configured to guide vertical movement of the car 8. The pair of counterweight guide rails 11 are configured to guide vertical movement of the counterweight 9. On a bottom of the hoistway 1, a car buffer 12 and a counterweight buffer 13 are installed.

A safety gear 14 is installed on a lower portion of the car 8. The safety gear 14 is configured to hold the car guide rails 10, to thereby bring the car 8 to an emergency stop. The safety gear 14 is provided with an actuation lever 15 configured to actuate the safety gear 14.

A speed governor 16 is provided in the machine room 2. The speed governor 16 is configured to monitor whether or not the car 8 runs at excessively high speed. Further, the speed governor includes a speed-governor sheave 17, an excessive-speed detection switch, and a rope catcher. A speed-governor rope 18 is wound around the speed-governor sheave 17.

The speed-governor rope 18 is laid in the hoistway 1 in an annular shape, and is connected to the actuation lever 15. A tension sheave 19 is provided on a lower portion of the hoistway 1. The speed-governor rope 18 is wound around the tension sheave 19. The speed-governor rope 18 is illustrated behind the car 8 in FIG. 1 to simplify illustration. However, in actuality, the speed-governor rope 18 is laid in a vicinity of one of the car guide rails 10.

When the car 8 is vertically moved, the speed-governor rope 18 is moved to circulate. Thus, the speed-governor sheave 17 is rotated at a rotation speed corresponding to a running speed of the car 8.

The speed governor 16 is configured to mechanically detect that the running speed of the car 8 has reached the excessive speed. A first excessive speed Vos and a second excessive speed Vtr are set in the speed governor 16. The first excessive speed Vos is higher than a rated speed Vr. The second excessive speed Vtr is higher than the first excessive speed.

When the running speed of the car 8 reaches the first excessive speed Vos, the excessive-speed detection switch is operated. Thus, supply of power to the hoisting machine 3 is interrupted, and the car 8 is brought to a sudden stop by the hoisting machine brake.

When a lowering speed of the car 8 reaches the second excessive speed Vtr, the speed-governor rope 18 is caught by the rope catcher, thereby stopping circulation of the speed-governor rope 18. Thus, the actuation lever 15 is operated to actuate the safety gear 14, and the car 8 is brought to an emergency stop.

Figure 2:
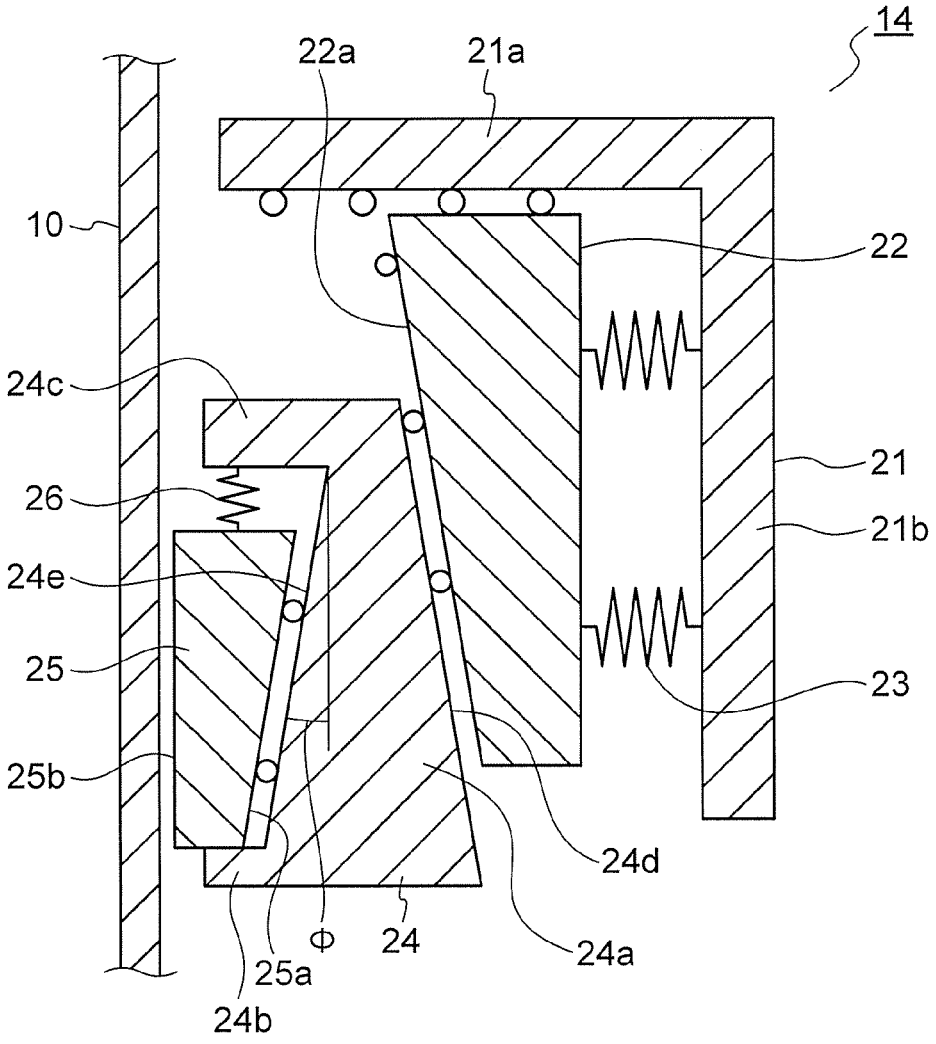
FIG. 2 is a sectional view for illustrating a main part of a safety gear of FIG. 1, and is an illustration of a normal state of the safety gear.

FIG. 2 is a sectional view for illustrating a main part of the safety gear 14 of FIG. 1, and is an illustration of a normal state of the safety gear 14. The safety gear 14 has the same configuration on both sides in a width direction of the car 8. Further, when the actuation lever 15 is operated, the safety gear 14 holds the pair of car guide rails 10 simultaneously.

The safety gear 14 according to the first embodiment includes a frame body 21, a normal wedge guide member 22, a pressing spring device 23, a normal wedge member 24, a reverse wedge member 25, and a vertical-direction spring device 26.

The frame body 21 is provided on the lower portion of the car 8. Further, the frame body 21 includes a horizontal portion 21*a* and a vertical portion 21*b*. The horizontal portion 21*a* is fixed to the lower portion of the car 8. The vertical portion 21*b* protrudes vertically downward from an end portion of the horizontal portion 21*a*. Further, the vertical portion 21*b* is opposed to the car guide rail 10.

The normal wedge guide member 22 is arranged below the horizontal portion 21*a*. Further, the normal wedge guide member 22 is movable along the horizontal portion 21*a*. That is, the normal wedge guide member 22 is movable with respect to the frame body 21 in a horizontal direction.

Moreover, the normal wedge guide member 22 has a normal wedge guide surface 22*a*. The normal wedge guide surface 22*a* is opposed to the car guide rail 10. Further, the normal wedge guide surface 22*a* is inclined with respect to the car guide rail 10 so as to become closer to the car guide rail 10 as extending upward, that is, a rising direction of the car 8.

The pressing spring device 23 is provided between the frame body 21 and the normal wedge guide member 22. Further, the pressing spring device 23 is configured to apply a resistance force against movement of the normal wedge guide member 22 in a direction of moving away from the car guide rail 10.

That is, the pressing spring device 23 is compressed by movement of the normal wedge guide member 22 toward the vertical portion 21*b* side. At this time, the pressing spring device 23 generates a force of pushing back the normal wedge guide member 22 toward the car guide rail 10 side. As the pressing spring device 23, for example, a plurality of Belleville-spring stacks are used. Each of the Belleville-spring stacks is formed of a plurality of Belleville springs staked in series.

The normal wedge member 24 is provided on the car guide rail 10 side of the normal wedge guide member 22. That is, the normal wedge member 24 is provided between the normal wedge guide member 22 and the car guide rail 10.

Further, the normal wedge member 24 includes a normal wedge main body 24*a*, a stopper portion 24*b*, and a spring bearing portion 24*c*. The stopper portion 24*b* protrudes horizontally from a lower end portion of the normal wedge main body 24*a* toward the car guide rail 10 side. The spring bearing portion 24*c* protrudes horizontally from an upper end portion of the normal wedge main body 24*a* toward the car guide rail 10 side.

The normal wedge main body 24*a* has a normal wedge surface 24*d* and a reverse wedge guide surface 24*e*. The normal wedge surface 24*d* is opposed to the normal wedge guide surface 22*a*. Further, the normal wedge surface 24*d* is inclined with respect to the car guide rail 10 so as to become closer to the car guide rail 10 as extending upward.

The reverse wedge guide surface 24*e* is opposed to the car guide rail 10. Further, the reverse wedge guide surface 24*e* is inclined with respect to the car guide rail 10 so as to become more distant from the car guide rail 10 as extending upward.

A gap between the normal wedge surface 24*d* and the reverse wedge guide surface 24*e* becomes smaller as extending upward. The normal wedge member 24 is pulled upward at the time of emergency braking of the car 8, and is moved upward with respect to the frame body 21 along the normal wedge guide surface 22*a*.

The reverse wedge member 25 is provided on the car guide rail 10 side of the normal wedge member 24. Further, the reverse wedge member 25 is movable with respect to the normal wedge member 24 along the reverse wedge guide surface 24*e*.

Moreover, the reverse wedge member 25 includes a reverse wedge surface 25*a* and a braking surface 25*b*. The reverse wedge surface 25*a* is opposed to the reverse wedge guide surface 24*e*. Further, the reverse wedge surface 25*a* is inclined with respect to the car guide rail 10 so as to become more distant from the car guide rail 10 as extending upward.

The braking surface 25*b* is opposed to the car guide rail 10. Further, the braking surface 25*b* is parallel to the car guide rail 10.

A gap between the reverse wedge surface 25*a* and the braking surface 25*b* becomes larger as extending upward. The reverse wedge member 25 is pulled upward together with the normal wedge member 24 at the time of emergency braking of the car 8, and is pressed against the car guide rail 10.

The vertical-direction spring device 26 is provided between the spring bearing portion 24*c* and an upper surface of the reverse wedge member 25. Further, the vertical-direction spring device 26 is configured to apply a resistance force against upward movement of the reverse wedge member 25 with respect to the normal wedge member 24.

That is, the vertical-direction spring device 26 is compressed by upward movement of the reverse wedge member 25 with respect to the normal wedge member 24. At this time, the vertical-direction spring device 26 generates a force of pushing back the reverse wedge member 25 downward with respect to the normal wedge member 24.

Figure 3:
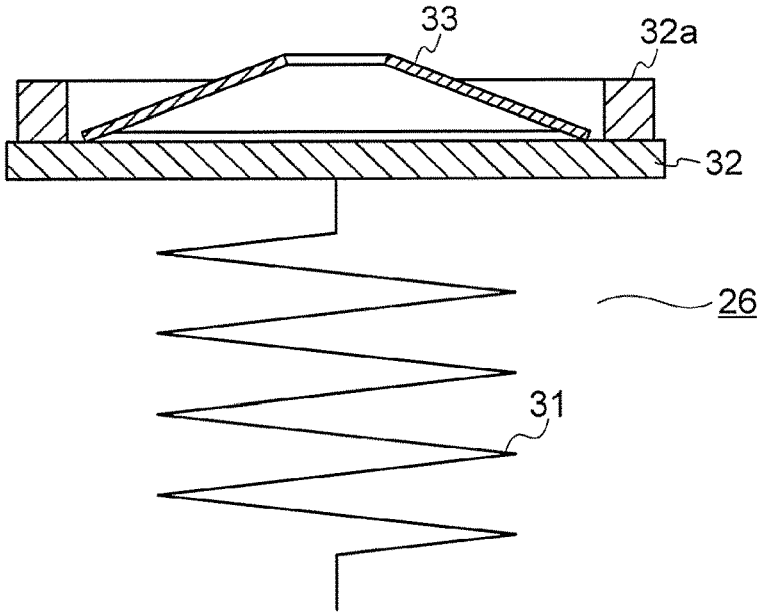
FIG. 3 is a schematic sectional view for illustrating an example of a vertical-direction spring device of FIG. 2.

FIG. 3 is a schematic sectional view for illustrating an example of the vertical-direction spring device 26 of FIG. 2. The vertical-direction spring device 26 includes a coil spring 31, a Belleville-spring bearing 32, and a Belleville spring 33. A lower end of the coil spring 31 is connected to the upper surface of the reverse wedge member 25.

The Belleville-spring bearing 32 is connected to an upper end of the coil spring 31. The Belleville spring 33 is retained on an upper portion of the Belleville-spring bearing 32. The coil spring 31 and the Belleville spring 33 are arranged in series. An upper end of the Belleville spring 33 is held in abutment against the spring bearing portion 24*c*.

A deformation regulating portion 32*a* is formed on an upper surface of the Belleville-spring bearing 32. The deformation regulating portion 32*a* is configured to mechanically regulate deformation of the Belleville spring 33, to thereby prevent buckling of the Belleville spring 33. Further, the deformation regulating portion 32*a* is arranged so as to surround a lower end portion of the Belleville spring 33. When the Belleville spring 33 bends significantly so that the deformation regulating portion 32*a* is brought into abutment against the spring bearing portion 24*c*, the Belleville spring 33 is prevented from being further deformed.

Figure 4:
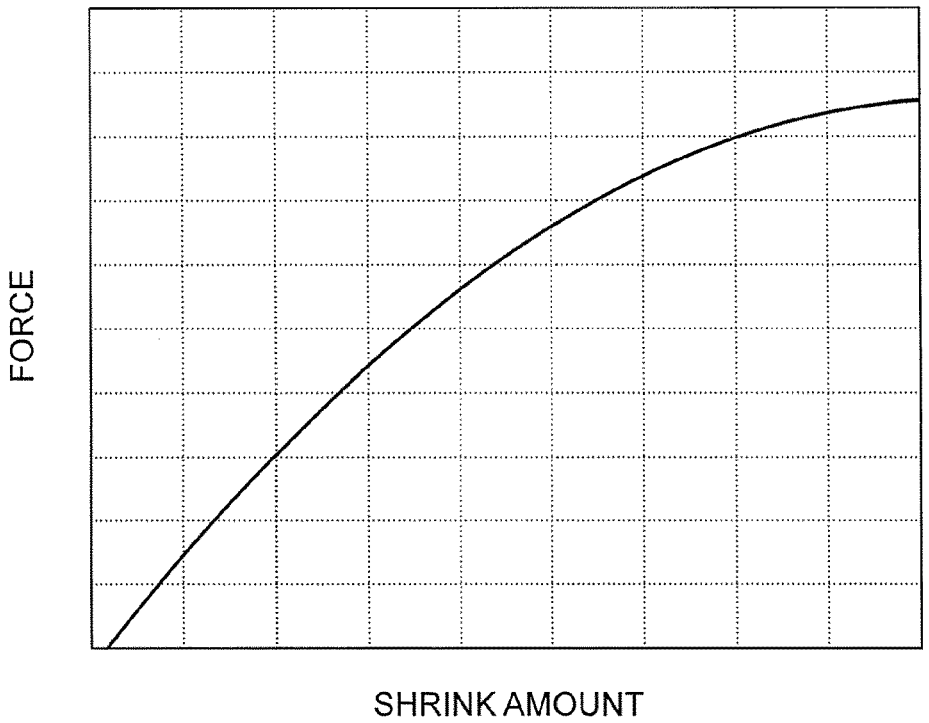
FIG. 4 is a graph for showing a characteristic of the vertical-direction spring device of FIG. 3.

A spring constant of the vertical-direction spring device 26 is lower than a spring constant of the pressing spring device 23. Further, as shown in FIG. 4, the vertical-direction spring device 26 has such a nonlinear characteristic that the spring constant decreases as a shrink amount increases. Moreover, the vertical-direction spring device 26 has a characteristic of having a region in which a rate of change in force generated along with increase in upward displacement amount of the reverse wedge member 25 with respect to the normal wedge member 24 smoothly decreases as compared to that in initial displacement.

Figure 5:
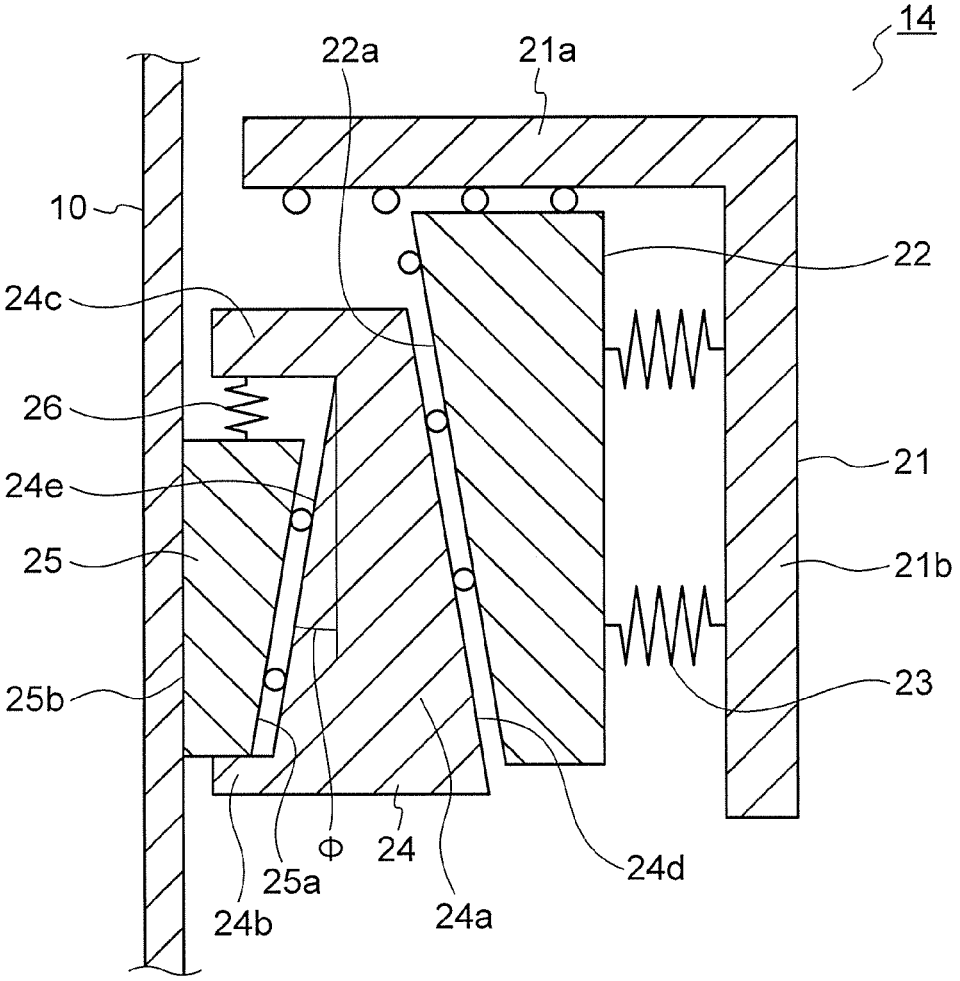
FIG. 5 is a sectional view for illustrating a main part of the safety gear of FIG. 2, and is an illustration of an actuated state of the safety gear.
Figure 6:
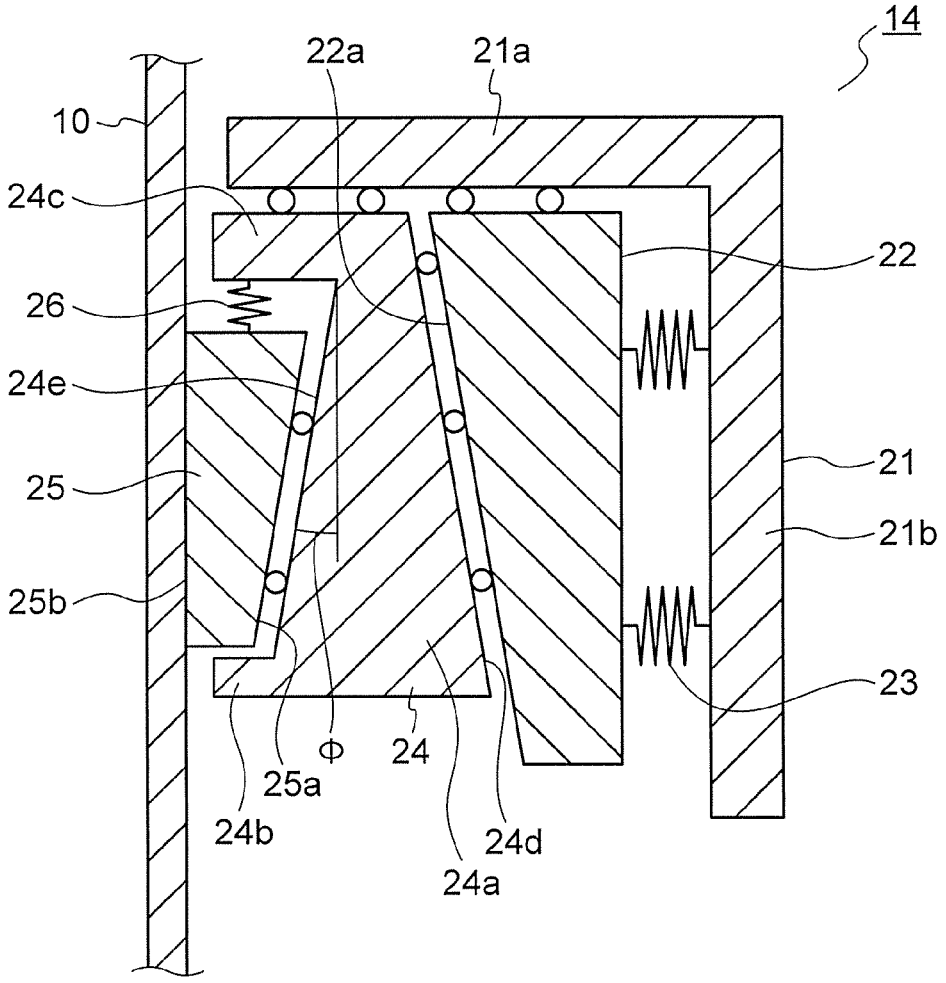
FIG. 6 is a sectional view for illustrating a main part of the safety gear, and is an illustration of a state in which a normal wedge member of FIG. 5 has been moved upward with respect to a frame body.
Figure 7:
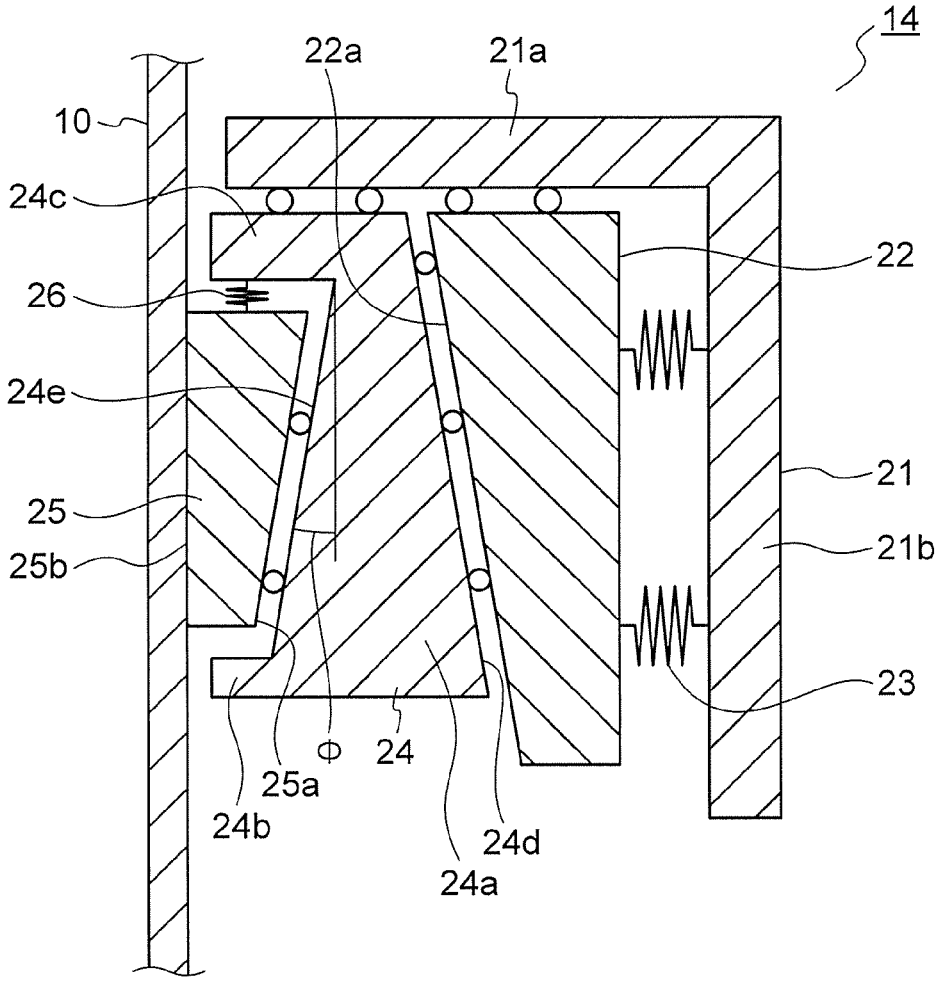
FIG. 7 is a sectional view for illustrating a main part of the safety gear, and is an illustration of a state in which a coefficient of friction between a reverse wedge member and a car guide rail of FIG. 6 is high.

FIG. 5 is a sectional view for illustrating a main part of the safety gear of FIG. 2, and is an illustration of an actuated state of the safety gear 14. FIG. 6 is a sectional view for illustrating a main part of the safety gear, and is an illustration of a state in which the normal wedge member 24 of FIG. 5 has been moved upward with respect to the frame body 21. FIG. 7 is a sectional view for illustrating a main part of the safety gear, and is an illustration of a state in which a coefficient of friction between the reverse wedge member 25 and the car guide rail 10 of FIG. 6 is high.

When the lowering speed of the car 8 has reached the second excessive speed Vtr, the actuation lever 15 is pulled upward with respect to the car 8 through the speed-governor rope 18. In this manner, as illustrated in FIG. 5, the normal wedge member 24 and the reverse wedge member 25 are pulled upward with respect to the frame body 21. Then, the braking surface 25*b* of the reverse wedge member 25 is brought into contact with the car guide rail 10.

After that, the normal wedge member 24 and the reverse wedge member 25 are brought into a space between the normal wedge guide surface 22*a* and the car guide rail 10. Thus, as illustrated in FIG. 6, the pressing spring device 23 is compressed.

In a stage in which the speed of the car 8 is high, the coefficient of friction between the reverse wedge member 25 and the car guide rail 10 is low. Accordingly, both a compression amount of the vertical-direction spring device 26 and an upward movement amount of the reverse wedge member 25 with respect to the normal wedge member 24 are small.

When the speed of the car 8 is low, the coefficient of friction between the reverse wedge member 25 and the car guide rails 10 is high. Accordingly, as illustrated in FIG. 7, both the compression amount of the vertical-direction spring device 26 and the upward movement amount of the reverse wedge member 25 with respect to the normal wedge member 24 are large.

At this time, when the vertical-direction spring device 26 is compressed, the reverse wedge member 25 is prone to move away from the car guide rail 10. As a result, the pressing spring device 23 is expanded so as to prevent the movement of the reverse wedge member 25 away from the car guide rail 10. In this manner, the reverse wedge member 25 is kept in abutment against the car guide rail 10 through intermediation of the normal wedge guide member 22 and the normal wedge member 24.

Owing to this action, a force of pressing the reverse wedge member 25 against the car guide rail 10 is reduced. Thus, the frictional force is reduced, and the braking force is prevented from being excessively large.

In contrast, when the vertical-direction spring device 26 is expanded, the reverse wedge member 25 causes the normal wedge member 24 to move away from the car guide rail 10. As a result, the pressing spring device 23 is compressed, and the force of pressing the reverse wedge member 25 against the car guide rail 10 is increased. Thus, the frictional force is increased, and the braking force is prevented from being excessively small.

As described above, in the first embodiment, the pressing force is mechanically and continuously adjusted in accordance with the change in coefficient of friction, thereby being capable of suppressing a change in frictional force. Further, the vertical-direction spring device 26 also functions as a spring device configured to detect the frictional force.

Figure 8:
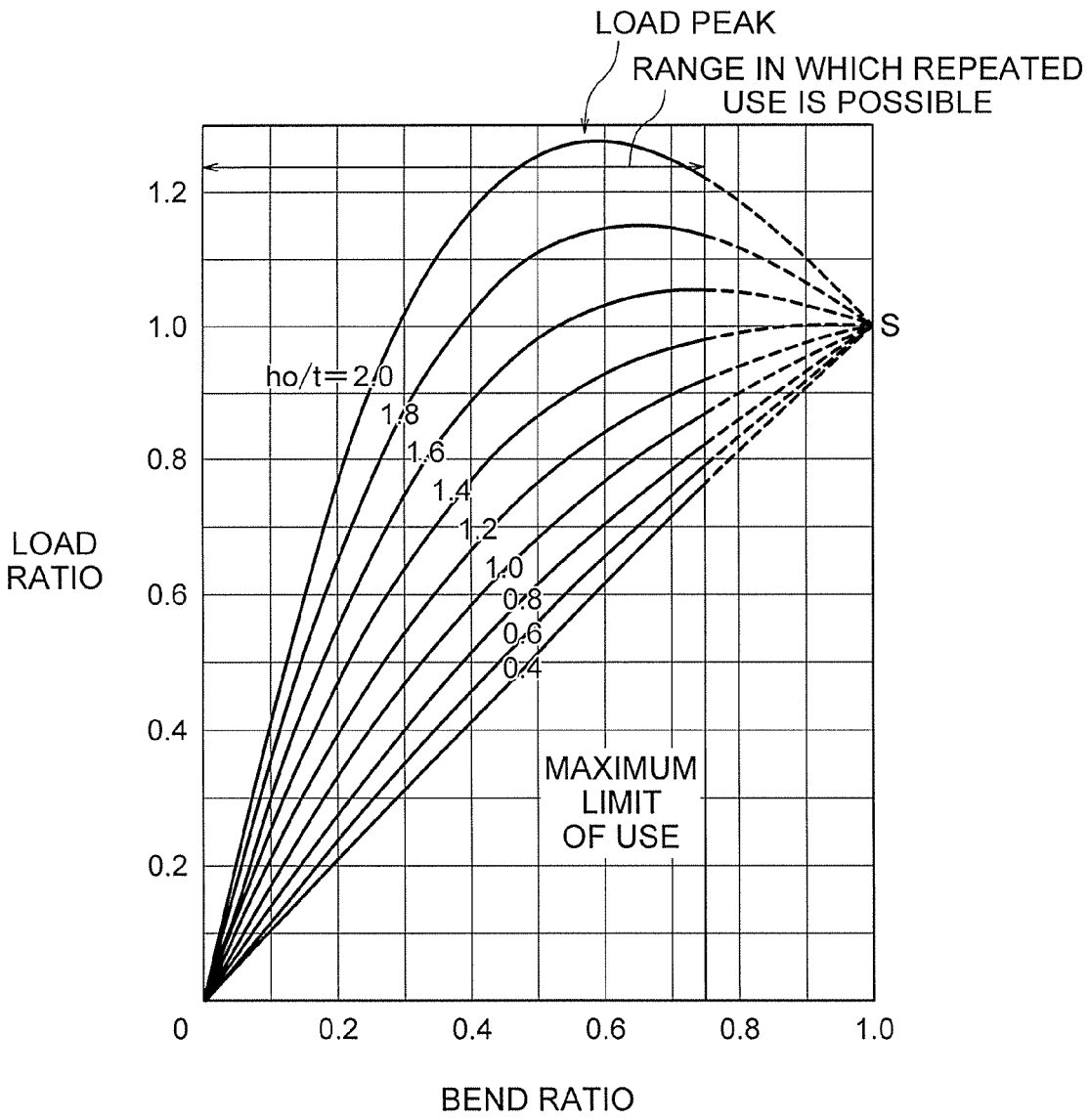
FIG. 8 is a graph for showing a relationship between a bend ratio and a load ratio in a typical Belleville spring.

Here, FIG. 8 is a graph for showing a relationship between a bend ratio and a load ratio in a typical Belleville spring. In FIG. 8, the relationship between the bend ratio and the load ratio is shown for each ratio of an effective height h0 of the Belleville spring to a thickness t of a material forming the Belleville spring. When the ratio h0/t exceeds 1.4, the Belleville spring having nonlinearity and a maximum value has a characteristic of close contact bend, that is, such a characteristic that load does not increase even when a degree of bend increases at a vicinity of maximum bend. Such nonlinearity increases as the value of the ratio h0/t increases.

In the first embodiment, through use of the nonlinear characteristic of the Belleville spring, that is, constant load at a vicinity of the maximum value, which does not depend on the shrink amount, sensitivity to dimensional tolerance can be reduced. Thus, even when the coefficient of friction changes or there is the dimensional tolerance, the braking force can be generated more stably.

In the safety gear 14 described above, the spring constant of the vertical-direction spring device 26 is lower than the spring constant of the pressing spring device 23. Further, the vertical-direction spring device 26 has the characteristic described above. Thus, even when the coefficient of friction between the reverse wedge member 25 and the car guide rail 10 changes, the braking force can be generated more stably while suppressing an impact generated on the car 8.

The following expression expresses a frictional force Fs of the safety gear 14 according to the first embodiment. The item "k1" represents the spring constant of the vertical-direction spring device 26. The item "k3" represents the spring constant of the pressing spring device 23. The item "φ" represents an inclination angle of the reverse wedge guide surface 24*e* with respect to the car guide rail 10 as illustrated in FIG. 2. The item "A" represents a coefficient relating to initial compression of the pressing spring device 23. The item "μ" represents the coefficient of friction. Further, the item "tan φ×μ" represents a nonnegative term.

$$F_s = \frac{k_1 A \times \mu}{\frac{k_1}{k_3} + \tan^2 \varphi + \tan \varphi \times \mu} \quad \text{[Expression 1]}$$

Figure 9:
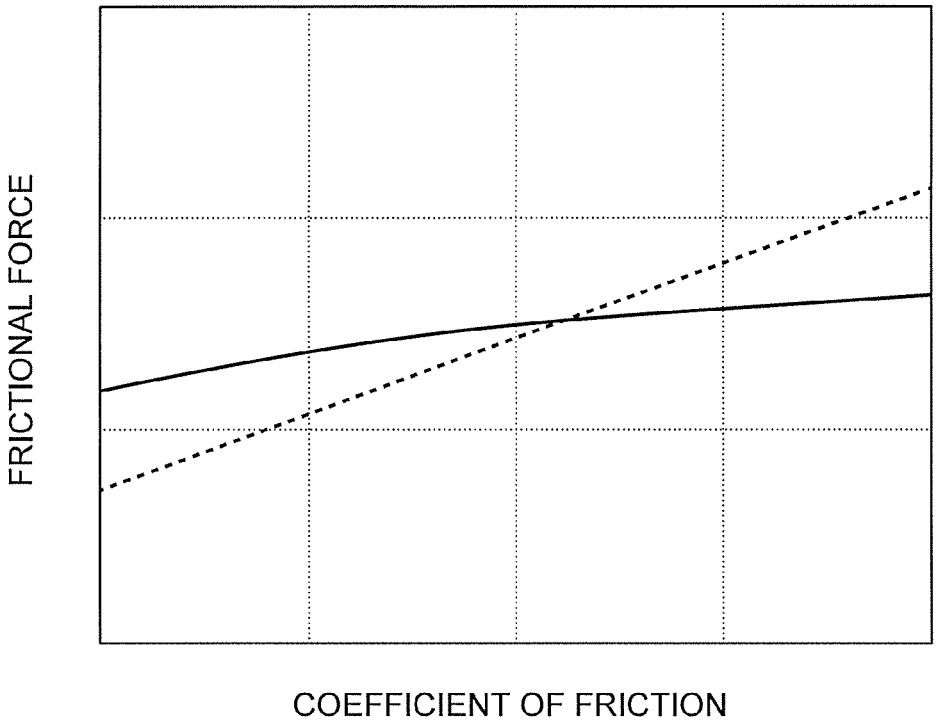
FIG. 9 is a graph for showing a relationship between a coefficient of friction and a frictional force in the safety gear according to the first embodiment.

FIG. 9 is a graph for showing a relationship between the coefficient of friction and the frictional force in the safety gear 14 according to the first embodiment. In FIG. 9, a characteristic of the safety gear 14 according to the first embodiment is indicated by the solid line. Further, in FIG. 9, a characteristic of a related-art typical safety gear without the reverse wedge member and the vertical-direction spring device is indicated by the broken line.

In the related-art typical safety gear, the frictional force changes in proportion to the coefficient of friction. In contrast, in the safety gear 14 according to the first embodiment, when a value of k1/k3 in Expression 1 above is approximated to 0, the change in frictional force can be suppressed against the change in coefficient of friction.

Further, when the value of k1/k3 is approximated to 0, the frictional force can be changed smoothly against the change in coefficient of friction. Thus, the braking force is prevented from being suddenly changed in accordance with the change in coefficient of friction, thereby being capable of suppressing generation of the impact on the car.

Moreover, the Belleville spring 33 is used. Thus, the characteristic of the vertical-direction spring device 26 can be adjusted with the simple configuration.

In addition, the deformation regulating portion 32*a* is formed on the Belleville-spring bearing 32. Thus, buckling of the Belleville spring 33 can be prevented with the simple configuration.

Further, in the first embodiment, the coil spring 31 and the Belleville spring 33 are coupled to each other in series. Further, the spring constant of the Belleville spring 33 in a low load range is lower than the spring constant of the coil spring 31, and is almost 0. Thus, when the reverse wedge member 25 is pulled upward, at first, the coil spring 31 is compressed significantly, and the Belleville spring 33 is easily compressed halfway through the upward pulling of the reverse wedge member 25. With this configuration, both extension of a stroke and a function of adjusting tolerance can be achieved.

When the coil spring 31 and the Belleville spring 33 are used in combination, the arrangement of the coil spring 31 and the Belleville spring 33 may be inverted.

Figure 10:
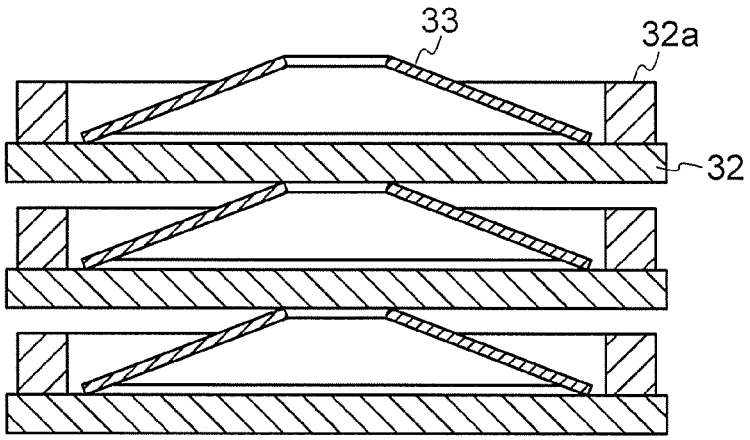
FIG. 10 is a sectional view for illustrating a first modification example of the vertical-direction spring device of FIG. 2.

Further, the configuration of the vertical-direction spring device 26 is not limited to the configuration illustrated in FIG. 3. For example, as illustrated in FIG. 10, the vertical-direction spring device 26 may have a configuration in which two or more combination sets of the Belleville-spring bearing 32 and the Belleville spring 33 are stacked in series. In this case, the coil spring 31 may be omitted. Further, the coil spring 31 may be added to the configuration of FIG. 10.

Figure 11:
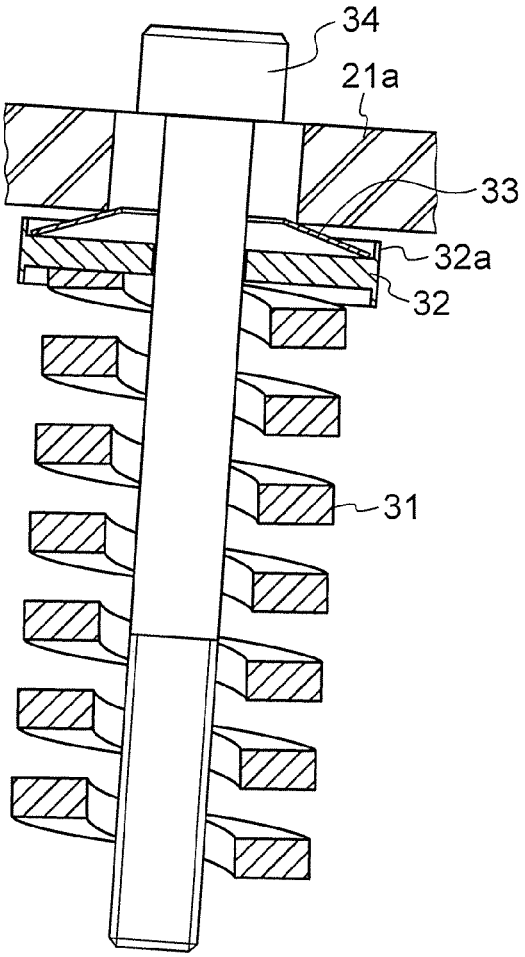
FIG. 11 is a sectional view for illustrating a second modification example of the vertical-direction spring device of FIG. 2.

Moreover, FIG. 11 is a view for illustrating a configuration in which a stopper bolt 34 is added to the vertical-direction spring device 26 illustrated in FIG. 3. A lower end portion of the stopper bolt 34 is screwed and fixed in a screw hole formed in an upper end of the reverse wedge member 25. Further, the stopper bolt 34 passes through the coil spring 31, the Belleville-spring bearing 32, the Belleville spring 33, and the horizontal portion 21*a*. Moreover, an upper end portion of the stopper bolt 34 protrudes upward from the horizontal portion 21*a*.

With this configuration, lateral displacement of the coil spring 31 and the Belleville spring 33 and occurrence of backlash can be suppressed. Further, initial load can be easily applied to the vertical-direction spring device 26.

In addition, a load characteristic of the vertical-direction spring device 26 is changed also by friction generated at a contact portion between the Belleville-spring bearing 32 and the Belleville spring 33. Accordingly, the load characteristic can be set in advance through selection of surface roughness of any one of the Belleville-spring bearing 32 and the Belleville spring 33 or through selection of materials for the Belleville-spring bearing 32 and the Belleville spring 33. Further, the load characteristic can be set in advance also through rounding of the contact portion between the Belleville spring 33 and the Belleville-spring bearing 32.

Further, in FIG. 2, the safety gear 14 is arranged on only one side of the car guide rail 10. However, the configurations of FIG. 2 may be arranged symmetrically on both sides of the car guide rail 10.

Figure 12:
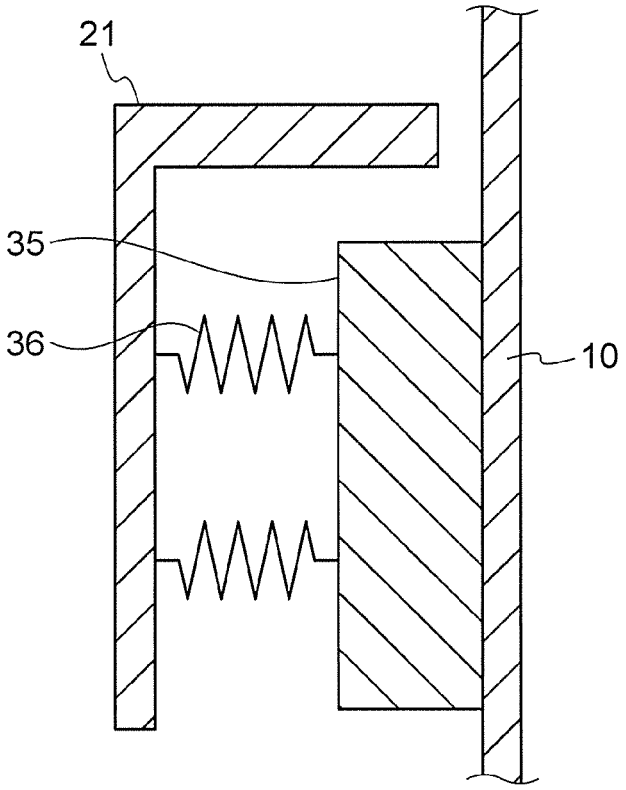
FIG. 12 is a sectional view for illustrating an example of a configuration arranged on a left side of the car guide rail of FIG. 2.

Moreover, on the left side of the car guide rail 10 of FIG. 2, a braking piece 35 and a braking piece spring device 36 as illustrated in FIG. 12 may be arranged. In a normal state, the braking piece 35 is opposed to the car guide rail 10 with a gap. Further, the braking piece 35 is supported by the frame body 21 through intermediation of the braking piece spring device 36.

When the safety gear 14 is actuated, the reverse wedge member 25 of FIG. 2 is pressed against the car guide rail 10. Thus, the car 8 and the frame body 21 are displaced with respect to the car guide rail 10 in a horizontal direction, that is, a rightward direction of FIG. 2. Thus, the braking piece 35 is pressed against the car guide rail 10, and the braking piece spring device 36 is compressed. As a result, the frictional force is generated between the braking piece 35 and the car guide rail 10.

Figure 13:
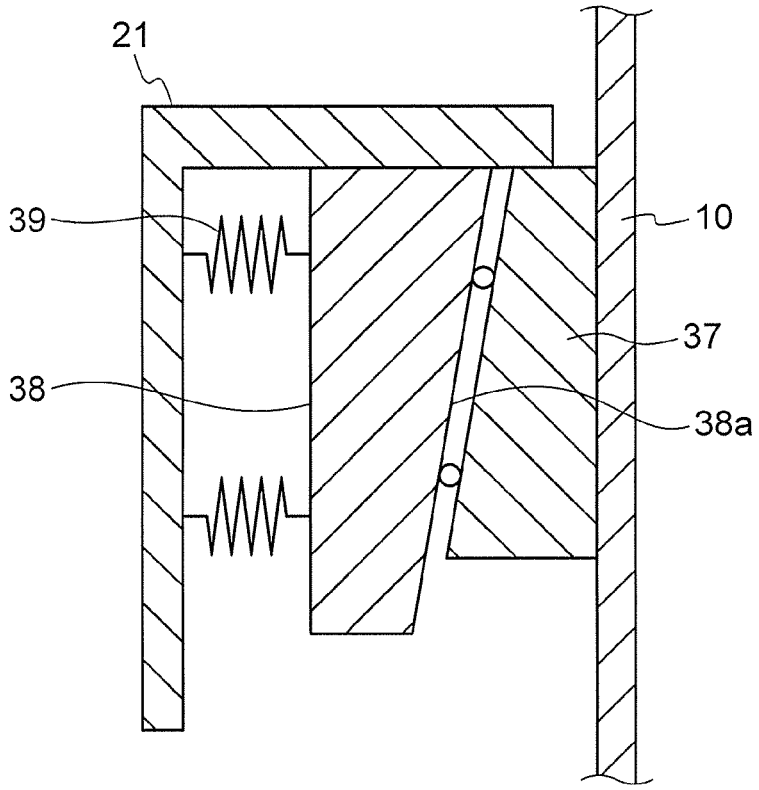
FIG. 13 is a sectional view for illustrating another example of the configuration arranged on the left side of the car guide rail of FIG. 2.

In addition, on the left side of the car guide rail 10 of FIG. 2, a wedge braking piece 37, a wedge-braking piece guide member 38, and a wedge-braking piece spring device 39 as illustrated in FIG. 13 may be arranged. In the normal state, the wedge braking piece 37 is positioned below a position of the wedge braking piece 37 illustrated in FIG. 13, and is opposed to the car guide rail 10 with a gap.

The wedge-braking piece guide member 38 is supported by the frame body 21 through intermediation of the wedge-braking piece spring device 39. Further, the wedge-braking piece guide member 38 has a wedge-braking piece guide surface 38*a*. The wedge-braking piece guide surface 38*a* is inclined with respect to the car guide rail 10 so as to become closer to the car guide rail 10 as extending upward.

When the safety gear 14 is actuated, the reverse wedge member 25 of FIG. 2 is pressed against the car guide rail 10. Thus, the car 8 and the frame body 21 are displaced with respect to the car guide rail 10 in the horizontal direction, that is, the rightward direction of FIG. 2. Thus, the wedge braking piece 37 is brought into contact with the car guide rail 10, and is moved upward with respect to the wedge-braking piece guide member 38.

As a result, the wedge-braking piece spring device 39 is compressed, and the frictional force is generated between the wedge braking piece 37 and the car guide rail 10. The wedge braking piece 37 may be pulled upward by the actuation lever 15 when the safety gear 14 is actuated.

Second Embodiment

Figure 14:
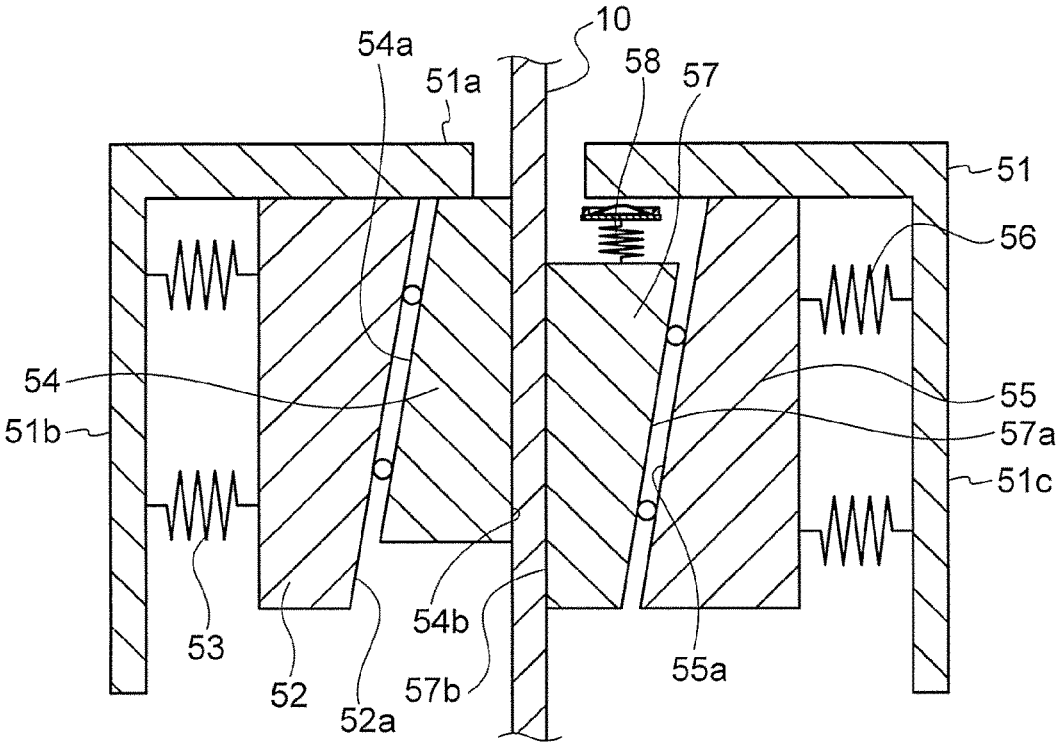
FIG. 14 is a sectional view for illustrating a main part of a safety gear according to a second embodiment of the present invention.

Next, FIG. 14 is a sectional view for illustrating a main part of a safety gear according to a second embodiment of the present invention, and is an illustration of an actuated state of the safety gear. The safety gear according to the second embodiment includes a frame body 51, a normal wedge guide member 52, a main pressing spring device 53, a normal wedge member 54, a reverse wedge guide member 55, an auxiliary pressing spring device 56, a reverse wedge member 57, and a vertical-direction spring device 58.

The frame body 51 includes a horizontal portion 51*a*, a first vertical portion 51*b*, and a second vertical portion 51*c*. The horizontal portion 51*a* is fixed to the lower portion of the car 8. The first vertical portion 51*b* protrudes vertically downward from one end of the horizontal portion 51*a*. The second vertical portion 51*c* protrudes vertically downward from another end of the horizontal portion 51*a*.

The first vertical portion 51*b* is opposed to one side of the car guide rail 10. The second vertical portion 51*c* is opposed to another side of the car guide rail 10.

The normal wedge guide member 52 is arranged below the horizontal portion 51*a* on one side of the car guide rail 10. Further, the normal wedge guide member 52 is movable along the horizontal portion 51*a*. That is, the normal wedge guide member 52 is movable with respect to the frame body 51 in a horizontal direction.

Moreover, the normal wedge guide member 52 has a normal wedge guide surface 52*a*. The normal wedge guide surface 52*a* is opposed to the car guide rail 10. Further, the normal wedge guide surface 52*a* is inclined with respect to the car guide rail 10 so as to become closer to the car guide rail 10 as extending upward.

The main pressing spring device 53 is provided between the frame body 51 and the normal wedge guide member 52. Further, the main pressing spring device 53 is configured to apply a resistance force against movement of the normal wedge guide member 52 in a direction of moving away from the car guide rail 10.

That is, the main pressing spring device 53 is compressed by movement of the normal wedge guide member 52 toward the first vertical portion 51*b* side. At this time, the main pressing spring device 53 generates a force of pushing back the normal wedge guide member 52 toward the car guide rail 10 side.

The normal wedge member 54 is provided on the car guide rail 10 side of the normal wedge guide member 52. That is, the normal wedge member 54 is provided between the normal wedge guide member 52 and the car guide rail 10.

Moreover, the normal wedge guide member 54 has a normal wedge guide surface 54*a* and a braking surface 54*b*. The normal wedge guide surface 54*a* is opposed to the normal wedge guide surface 52*a*. Further, the normal wedge guide surface 54*a* is inclined with respect to the car guide rail 10 so as to become closer to the car guide rail 10 as extending upward.

The braking surface 54*b* is opposed to the car guide rail 10 in a normal state. Further, the braking surface 54*b* is parallel to the car guide rail 10.

A gap between the normal wedge surface 54*a* and the braking surface 54*b* becomes smaller as extending upward. The normal wedge member 54 is pulled upward at the time of emergency braking of the car 8, and is moved along the normal wedge guide surface 52*a* and pressed against the car guide rail 10.

The reverse wedge guide member 55 is provided on the frame body 51 on an opposite side of the normal wedge member 54 with respect to the car guide rail 10. The reverse wedge guide member 55 is arranged below the horizontal portion 51*a* on another side of the car guide rail 10. Further, the reverse wedge guide member 55 is movable along the horizontal portion 51*a*. That is, the reverse wedge guide member 55 is movable with respect to the frame body 51 in the horizontal direction.

Moreover, the reverse wedge guide member 55 has a reverse wedge guide surface 55*a*. The reverse wedge guide surface 55*a* is opposed to the car guide rail 10. Further, the reverse wedge guide surface 55*a* is inclined with respect to the car guide rail 10 so as to become more distant from the car guide rail 10 as extending upward.

The auxiliary pressing spring device 56 is provided between the frame body 51 and the reverse wedge guide member 55. Further, the auxiliary pressing spring device 56 is configured to apply a resistance force against movement of the reverse wedge guide member 55 in a direction of moving away from the car guide rail 10.

That is, the auxiliary pressing spring device 56 is compressed by movement of the reverse wedge guide member 55 toward the second vertical portion 51*c* side. At this time, the auxiliary pressing spring device 56 generates a force of pushing back the reverse wedge guide member 55 toward the car guide rail 10 side. As the main pressing spring device 53 and the auxiliary pressing spring device 56, for example, a plurality of Belleville-spring stacks are used.

The reverse wedge member 57 is provided on the car guide rail 10 side of the reverse wedge guide member 55. Further, the reverse wedge member 57 is movable with respect to the reverse wedge guide member 55 along the reverse wedge guide surface 55*a*.

Moreover, the reverse wedge member 57 includes a reverse wedge surface 57*a* and a contact surface 57*b*. The reverse wedge surface 57*a* is opposed to the reverse wedge guide surface 55*a*. Further, the reverse wedge surface 57*a* is inclined with respect to the car guide rail 10 so as to become more distant from the car guide rail 10 as extending upward.

The contact surface 57*b* is opposed to the car guide rail 10 in a normal state. Further, the contact surface 57*b* is parallel to the car guide rail 10.

A gap between the reverse wedge surface 57*a* and the contact surface 57*b* becomes smaller as extending upward. When the safety gear is actuated, the normal wedge member 54 is pressed against the car guide rail 10. Thus, the car 8 and the frame body 51 are displaced with respect to the car guide rail 10 in the horizontal direction, that is, a leftward direction of FIG. 14. Thus, the contact surface 57*b* is brought into contact with the car guide rail 10.

The vertical-direction spring device 58 is provided between the horizontal portion 51*a* and an upper surface of the reverse wedge member 57. Further, the vertical-direction spring device 58 is configured to apply a resistance force against upward movement of the reverse wedge member 57 with respect to the normal wedge member 55.

That is, the vertical-direction spring device 58 is compressed by upward movement of the reverse wedge member 57 with respect to the normal wedge member 24. At this time, the vertical-direction spring device 58 generates a force of pushing back the reverse wedge member 25 downward with respect to the normal wedge member 24.

As the vertical-direction spring device 58, the same spring device as the vertical-direction spring device 26 in the first embodiment is used. Further, a characteristic of the vertical-direction spring device 58 is the same as the characteristic of the vertical-direction spring device 26 in the first embodiment.

Moreover, a spring constant of the vertical-direction spring device 58 is lower than the spring constant of the main pressing spring device 53 and the spring constant of the auxiliary pressing spring device 56. In addition, an upper end portion of the vertical-direction spring device 58 is movable with respect to the horizontal portion 51*a* in the horizontal direction. All other configurations and operations are similar or identical to the first embodiment.

In this configuration, when the vertical-direction spring device 58 is compressed, the reverse wedge member 57 is prone to move away from the car guide rail 10. As a result, the main pressing spring device 53 and the auxiliary pressing spring device 56 are expanded so as to prevent the movement of the reverse wedge member 57 away from the car guide rail 10. In this manner, the reverse wedge member 57 is kept in abutment against the car guide rail 10.

Owing to this action, a force of pressing the normal wedge member 54 against the car guide rail 10 is reduced. Thus, the frictional force is reduced, and the braking force is prevented from being excessively large.

In contrast, when the vertical-direction spring device 58 is expanded, the reverse wedge member 55 causes the reverse wedge member 57 to move away from the car guide rail 10. As a result, the main pressing spring device 53 and the auxiliary pressing spring device 56 are compressed, and the force of pressing the normal wedge member 54 against the car guide rail 10 is increased. Thus, the frictional force is increased, and the braking force is prevented from being excessively small.

Thus, similarly to the first embodiment, even when the coefficient of friction between the reverse wedge member 57 and the car guide rail 10 changes, the braking force can be generated more stably while suppressing an impact generated on the car 8.

Oil may be applied to a contact portion between the vertical-direction spring device 58 and the horizontal portion 51*a*. Further, a linear guide configured to guide movement of the vertical-direction spring device 58 may be provided on a lower surface of the horizontal portion 51*a*. With this configuration, the vertical-direction spring device 58 can be smoothly moved with respect to the horizontal portion 51*a*.

Figure 15:
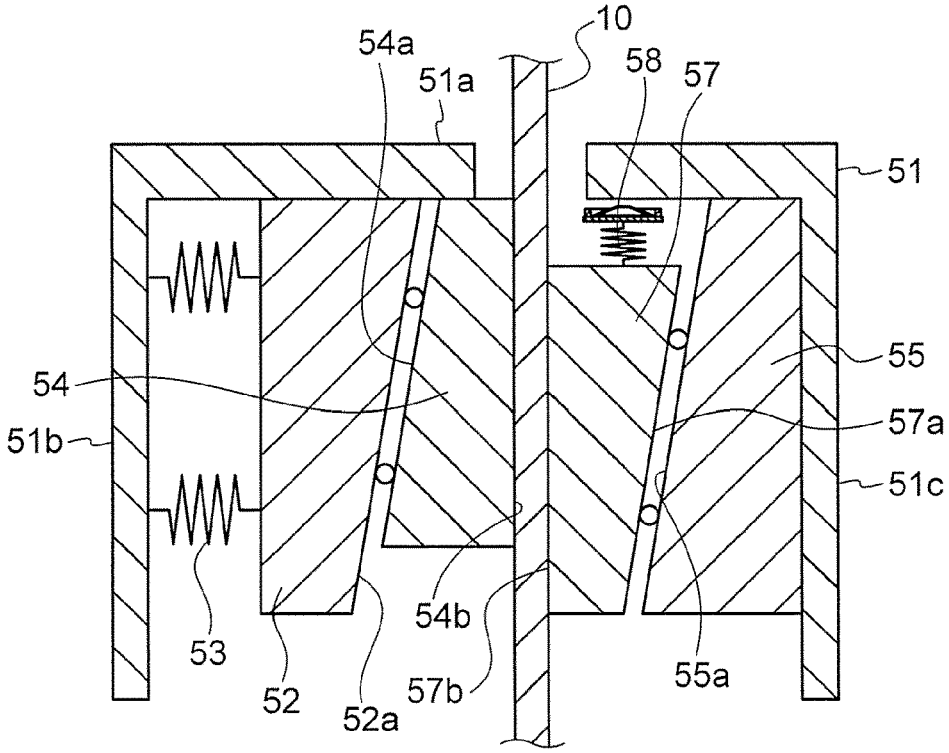
FIG. 15 is a sectional view for illustrating a main part of the safety gear of FIG. 14 in a modification example.

Further, as illustrated in FIG. 15, the auxiliary pressing spring device 56 may be omitted. In this case, an upper end portion of the vertical-direction spring device 58 can be fixed to the horizontal portion 51*a*.

Moreover, the present invention is also applicable to a safety gear installed on a counterweight. That is, the ascending/descending body may be the counterweight.

In addition, an overall layout of the elevator is not limited to the layout of FIG. 1. For example, the present invention is also applicable to an elevator using a 2:1 roping method.

Further, the present invention is also applicable to elevators of various types such as a machine room-less elevator, a double-deck elevator, and a one-shaft multi-car system elevator. The one-shaft multi-car system is a system in which an upper car and a lower car arranged directly below the upper car are vertically moved in the common ascending/descending body independently.

REFERENCE SIGNS LIST

8 car (ascending/descending body), 10 car guide rail, 14 safety gear, 21, 51 frame body, 22, 52 normal wedge guide member, 22*a*, 52*a* normal wedge guide surface, 23 pressing spring device, 24, 54 normal wedge member, 24*e*, 55*a* reverse wedge guide surface, 25, 57 reverse wedge member, 26, 58 vertical-direction spring device, 32*a* deformation regulating portion, 33 Belleville spring, 53 main pressing spring device, 55 reverse wedge guide member, 56 auxiliary pressing spring device

The invention claimed is:

1. A safety gear for an elevator, comprising:

a frame body on an ascending/descending body that moves while being guided along a guide rail;

a normal wedge guide, which has a normal wedge guide surface becoming closer to the guide rail as extending upward, and is movable with respect to the frame body in a horizontal direction;

a pressing spring, which is between the frame body and the normal wedge guide, is to apply a pushing force against movement of the normal wedge guide in a direction of moving away from the guide rail;

a normal wedge, which is on a guide rail side of the normal wedge guide, and is pulled upward at a time of emergency braking of the ascending/descending body to be moved along the normal wedge guide surface;

a reverse wedge, which is on the guide rail side of the normal wedge, and is pulled upward together with the normal wedge at the time of emergency braking of the ascending/descending body to be pressed against the guide rail; and a vertical-direction spring on an upper-most surface of the reverse wedge, wherein the normal wedge has a reverse wedge guide surface becoming more distant from the guide rail as extending upward, wherein the reverse wedge is movable with respect to the normal wedge along the reverse wedge guide surface, wherein the vertical-direction spring is to apply a pushing force against upward movement of the reverse wedge with respect to the normal wedge, wherein a spring constant of the vertical-direction spring is lower than a spring constant of the pressing spring, wherein the vertical-direction spring has a characteristic of having a region in which a rate of change in force generated along with increase in upward displacement amount of the reverse wedge with respect to the normal wedge decreases as compared to that in initial displacement, wherein the normal wedge includes a stopper portion and a spring bearing portion, wherein the reverse wedge is between the stopper portion and the spring bearing portion, and wherein the vertical-direction spring is provided between a lower surface of the spring bearing portion and the upper-most surface of the reverse wedge.

2. The safety gear for an elevator according to claim 1, wherein the vertical-direction spring includes a Belleville spring.

3. The safety gear for an elevator according to claim 2, wherein the vertical-direction spring includes a deformation regulator to mechanically regulate deformation of the Belleville spring, to thereby prevent buckling of the Belleville spring.

4. The safety gear for an elevator according to claim 1, wherein a first length of the reverse wedge is less than a second length of the normal wedge.

5. A safety gear for an elevator, comprising:

a frame body on an ascending/descending body that moves while being guided along a guide rail;

a normal wedge guide, which has a normal wedge guide surface becoming closer to the guide rail as extending upward, and is movable with respect to the frame body in a horizontal direction;

a main pressing spring between the frame body and the normal wedge guide to apply a pushing force against movement of the normal wedge guide in a direction of moving away from the guide rail;

a normal wedge, which is on a guide rail side of the normal wedge guide, and is pulled upward at a time of emergency braking of the ascending/descending body to be moved along the normal wedge guide surface and pressed against the guide rail;

a reverse wedge guide on the frame body on an opposite side of the normal wedge with respect to the guide rail;

a reverse wedge on the guide rail side of the reverse wedge guide; and a vertical-direction spring on an upper-most surface of the reverse wedge, wherein the reverse wedge guide has a reverse wedge guide surface becoming more distant from the guide rail as extending upward, wherein the reverse wedge is movable with respect to the reverse wedge guide along the reverse wedge guide surface, wherein the vertical-direction spring is to apply a pushing force against upward movement of the reverse wedge with respect to the reverse wedge guide, wherein a spring constant of the vertical-direction spring is lower than a spring constant of the main pressing spring, wherein the vertical-direction spring has a characteristic of having a region in which a rate of change in force generated along with increase in upward displacement amount of the reverse wedge with respect to the reverse wedge guide decreases as compared to that in initial displacement, wherein the frame body includes a horizontal portion, and wherein the vertical-direction spring is between a lower surface of the horizontal portion of the frame body and the upper-most surface of the reverse wedge.

6. The safety gear for an elevator according to claim 5, wherein the vertical-direction spring includes a Belleville spring.

7. The safety gear for an elevator according to claim 6, wherein the vertical-direction spring includes a deformation regulator to mechanically regulate deformation of the Belleville spring, to thereby prevent buckling of the Belleville spring.

8. The safety gear for an elevator according to claim 5, wherein a first length of the reverse wedge is less than a second length of the reverse wedge guide.

* * * * *